United States Patent [19]

Lordahl

[11] Patent Number: 4,580,469

[45] Date of Patent: Apr. 8, 1986

[54] TOOL AND SPANNER WRENCH

[76] Inventor: Var E. Lordahl, 316 Austin, Park Ridge, Ill. 60068

[21] Appl. No.: 781,681

[22] Filed: Sep. 30, 1985

[51] Int. Cl.[4] ..... B25F 1/00

[52] U.S. Cl. ..... 81/437; 81/439

[58] Field of Search ..... 81/437, 439

[56] References Cited

U.S. PATENT DOCUMENTS 363,331 5/1887 Hammer ..... 81/437

4,037,275 7/1977 Schor ..... 81/437

*Primary Examiner*—Frederick R. Schmidt

*Assistant Examiner*—J. T. Zatarga

*Attorney, Agent, or Firm*—Wm A. Snow

[57] ABSTRACT

A tool for removing nuts having slots around its circumference and nuts having varying circumferences. The tool is provided with downwardly and integrally extending short ears. The ears extend downwardly at various edges of the tool having greater distances from each other. The tool is also provided with an outwardly integrally formed Allen wrench and the tool is also provided with an elongated Allen wrench extending outwardly of the tool.

2 Claims, 5 Drawing Figures

TOOL AND SPANNER WRENCH

BACKGROUND OF THE INVENTION

There has been a need to produce a tool that can be used with various size faucet valve stem holddown nuts, holddown rings and the like, particularly used with Delta, Peerless, Valley, Aqualine, Elger, Sears and other faucets.

SUMMARY OF THE INVENTION

A tool or wrench having an elongated body having radiused side walls wherein the body is provided with extensions therefrom with formed downwardly extending pairs of spaced ears of various lengths, a downwardly extending elongated ear, outwardly extending spaced ears and an outwardly extending Allen wrench, all integrally formed on the body by stamping from a single piece of metal.

DETAILED DESCRIPTION OF THE INVENTION

Figure 1:
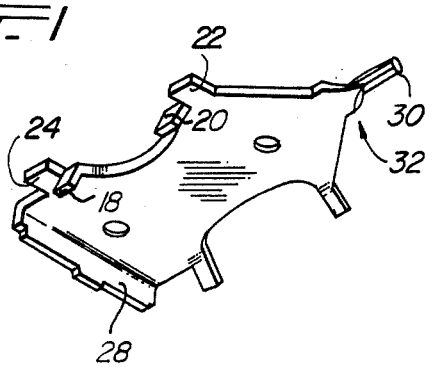
FIG. 1 is a perspective view of the tool or wrench of the present invention looking at the bottom of the same.
Figure 2:
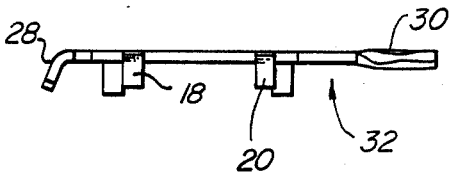
FIG. 2 is a side elevational view of FIG. 1 taken on the line 2—2 of FIG. 3.
Figure 3:
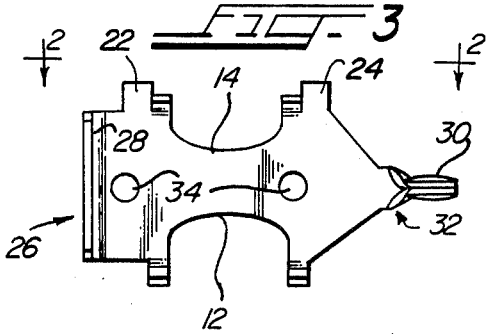
FIG. 3 is a top elevational view thereof.
Figure 4:
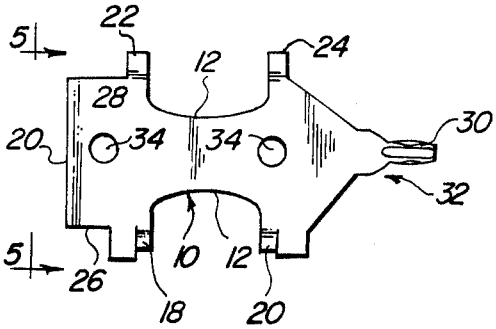
FIG. 4 is a bottom elevational view thereof.
Figure 5:
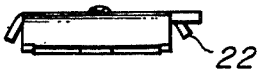
FIG. 5 is an end elevational view taken on the line 5—5 of FIG. 5.

The tool is made of metal and is stamped on a stamping machine to provide a body 10. A pair of side walls on said body. A part of the side walls are radiused as at 12, 14. A pair of integrally formed, outwardly extending, spaced ears 22, 24 are positioned on one of the side walls adjacent the ends of the radius 14 as shown in the drawings. Adjacent the ears 22, 24 are a pair of integrally formed, spaced, downwardly projecting ears 18, 20. On the opposite side wall, adjacent the ends of the radius 12, are a pair of integrally formed, diagonally spaced ears 22, 24.

At the rear end 26 of the body 10 is an elongated, downwardly projecting, diagonally extending and integrally formed ear 28. A forwardly extending, integrally formed Allen wrench 30 is provided at the forward end 32 of the body 10. A pair of spaced apertures 34 are provided in the body 10 for ease of hanging up so as not to get lost.

It is to be noted from the drawing that all of the ears are of different width so as to fit any width slot in faucets or anywhere else a spanner wrench of these dimensions is needed.

Thus the present invention is a combination of various sizes of spanner wrench and an Allen wrench as one tool to create a single tool for workmen. As noted in the drawing, each pair of ears and the ear on the rear of said body are of different widths.

Although but one specific embodiment of this invention is herein shown and described, it will be understood that details of the construction shown may be altered or omitted without departing from the spirit of the invention as defined by the following claims.

I claim:

1. A combination of multiple spanner wrench and Allen wrench all formed by stamping the same out of a single piece of metal, comprising a body having a pair of side walls, a rear end and a front end, a portion of each side wall being radiused, a pair of spaced, downwardly and diagonally positioned ears on one of said side walls of said body, spaced, outwardly extending ears adjacent the side of said ears and downwardly diagonally extending spaced ears on the opposite side wall, the end of said rear end of said body being bent downwardly and diagonally to form another ear and an Allen wrench formed on the front end of said body and extending forwardly therefrom.

2. The spanner wrench of claim 1 wherein each pair of ears is of a different length and each pair of ears has a different width.

* * * * *